US012655563B2

(12) United States Patent
Han et al.

(10) Patent No.: US 12,655,563 B2
(45) Date of Patent: Jun. 16, 2026

(54) DRYER

(71) Applicant: SAMSUNG ELECTRONICS CO., LTD., Suwon-Si (KR)

(72) Inventors: Jeongsu Han, Suwon-si (KR); Doyoon Kim, Suwon-si (KR); Hoyoung Kim, Suwon-si (KR); Taegyoon Noh, Suwon-si (KR); Junhoe Choi, Suwon-si (KR); Jaebok Lee, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 758 days.

(21) Appl. No.: 18/118,424

(22) Filed: Mar. 7, 2023

(65) Prior Publication Data

US 2023/0220600 A1 Jul. 13, 2023

Related U.S. Application Data

(63) Continuation of application No. PCT/KR2021/008973, filed on Jul. 13, 2021.

(30) Foreign Application Priority Data

Sep. 8, 2020 (KR) ..... 10-2020-0114946

(51) Int. Cl.
*D06F 37/06* (2006.01)
*D06F 33/30* (2020.01)
(Continued)

(52) U.S. Cl.
CPC ..... *D06F 34/10* (2020.02); *D06F 34/26* (2020.02); *D06F 58/04* (2013.01); *D06F 2103/08* (2020.02)

(58) Field of Classification Search
CPC ..... D06F 37/065; D06F 58/04; D06F 58/02; D06F 58/30; D06F 2105/12;
(Continued)

(56) References Cited

U.S. PATENT DOCUMENTS 9,951,465 B1 * 4/2018 Herschler ..... D06F 34/05
12,286,742 B2 * 4/2025 Min ..... D06F 34/05
(Continued)

FOREIGN PATENT DOCUMENTS

CN 104619906 A 5/2015
CN 111188177 A 5/2020
(Continued)

OTHER PUBLICATIONS

International Search Report issued in International Application No. PCT/KR2021/008973 dated Oct. 25, 2021.
Written Opinion issued in International Application No. PCT/KR2021/008973 dated Oct. 25, 2021.
Korean Office Action issued Aug. 28, 2025 for Application No. 10-2020-0114946.

*Primary Examiner* — Deming Wan
(74) *Attorney, Agent, or Firm* — STAAS & HALSEY LLP

(57) ABSTRACT

A dryer includes a rotating drum; a lifter positionable on an inner surface of the rotating drum; an energy harvester positionable inside the lifter so that while the energy harvester is positioned inside the lifter, the energy harvester generates electric power as the rotating drum rotates while the lifter is positioned on the inner surface of the rotating drum; a humidity sensor positionable inside the lifter so that while the humidity sensor is positioned inside the lifter, the humidity sensor receives the electric power generated by the energy harvester and senses humidity; a circuit board positionable inside the lifter and on which the humidity sensor is disposed; and an air passage formed through the lifter so as to allow air inside the rotating drum to pass through the lifter. The humidity sensor senses the humidity according to air passing through the air passage of the lifter.

15 Claims, 20 Drawing Sheets

(51) Int. Cl.

| | |
|---|---|
| ***D06F 34/05*** | (2020.01) |
| ***D06F 34/10*** | (2020.01) |
| ***D06F 34/26*** | (2020.01) |
| ***D06F 58/02*** | (2006.01) |
| ***D06F 58/04*** | (2006.01) |
| ***D06F 58/30*** | (2020.01) |
| ***H02J 50/10*** | (2016.01) |
| *D06F 103/08* | (2020.01) |

(58) Field of Classification Search

CPC ..... D06F 2103/08; F06F 34/10; F06F 34/05; F06F 34/26; F06F 34/00; F06F 34/30; H02J 50/10; H02J 50/001; H02J 50/05

USPC ..... 34/524, 321, 445

See application file for complete search history.

(56) References Cited

U.S. PATENT DOCUMENTS

| | | | |
|---|---|---|---|
| 2019/0319489 | A1 | 10/2019 | Chiriatti |
| 2022/0064839 | A1 | 3/2022 | Kim et al. |

FOREIGN PATENT DOCUMENTS

| | | | |
|---|---|---|---|
| DE | 10 2018 219 349 | A1 | 5/2020 |
| EP | 1 895 043 | A1 | 3/2008 |
| EP | 1 997 951 | B1 | 3/2011 |
| JP | 2010-240181 | A | 10/2010 |
| JP | 2014-030470 | A | 2/2014 |
| KR | 10-0651903 | B1 | 12/2006 |
| KR | 10-2020-0089080 | A | 7/2020 |
| WO | WO 2020/099017 | A1 | 5/2020 |

* cited by examiner

DRYER

CROSS-REFERENCE TO RELATED APPLICATIONS

This application is a continuation application, under 35 U.S.C. § 111(a), of international application No. PCT/KR2021/008973, filed on Jul. 13, 2021, which claims priority of a Korean patent application number 10-2020-0114946, filed Sep. 8, 2020, in the Korean Intellectual Property Office, the disclosures of which are incorporated by reference herein in their entirety.

BACKGROUND

Field

The disclosure relates to relates to a dryer, and more particularly, to a dryer including a sensing device capable of measuring an internal state of the dryer.

Description of the Related Art

Generally, a dryer includes a cylindrical rotating drum into which an object to be dried is put, an air circulator that circulates air in the rotating drum, and a heater that heats medium-temperature and high-humidity air discharged from the rotating drum into high-temperature and low-humidity air.

In order to effectively dry the object to be dried, the rotating drum is formed to continuously rotate so that air of high-temperature and low-humidity may uniformly contact the object to be dried.

In order to check the drying state of the object to be dried, it is necessary to dispose a humidity sensor inside the rotating drum. However, because the rotating drum continuously rotates, there is a problem in that it is difficult to dispose the humidity sensor inside the rotating drum and supply electric power thereto.

Therefore, in the dryer according to the prior art, an electrode sensor is disposed on a part of the rotating drum that does not rotate, and the contact time and voltage with the object to be dried were measured by the electrode sensor to determine the drying degree of the object to be dried.

However, although the humidity measuring device according to the prior art is simple to install, there is a problem in that the measured drying degree of the object to be dried is inaccurate.

For example, the object to be dried may not contact the electrode sensor due to the eccentricity of the object to be dried. In addition, the object to be dried is not well mixed, so that only the drying degree of a specific part of the object to be dried may be measured. In this case, the dryer may misidentify the drying degree of the object to be dried.

When the object to be dried is less dried, the consumer needs to perform additional drying. Therefore, the consumer may feel uncomfortable. Conversely, when the object to be dried is too dry, the object to be dried may be damaged.

To solve this problem, a method of wirelessly supplying power from an external power supply to a humidity sensor inside the rotating drum by installing the power supply and a power transmitter outside the rotating drum and installing the humidity sensor and a power receiver inside the rotating drum has been proposed. However, this humidity measuring device has a problem in that the device is complicated because it is supplied with power wirelessly.

Therefore, there is a need for a method capable of accurately and conveniently measuring the drying degree of the object to be dried with a simple structure when drying with a dryer.

SUMMARY

According to an aspect of the disclosure, a dryer may include a rotating drum; a lifter positionable on an inner surface of the rotating drum; an energy harvester positionable inside the lifter so that while the energy harvester is positioned inside the lifter, the energy harvester generates electric power as the rotating drum rotates while the lifter is positioned on the inner surface of the rotating drum; a humidity sensor positionable inside the lifter so that while the humidity sensor is positioned inside the lifter, the humidity sensor receives the electric power generated by the energy harvester and senses humidity; a circuit board positionable inside the lifter, the humidity sensor being disposed on the circuit board; and an air passage formed through the lifter so as to allow air inside the rotating drum to pass through the lifter. The humidity sensor senses the humidity according to air passing through the air passage of the lifter.

The air passage may include an inlet formed on a front surface of the lifter and an outlet formed on a rear surface of the lifter facing the front surface.

The air passage may include a connection duct that connects the inlet and the outlet and is formed to allow air inside the rotating drum to pass therethrough. The humidity sensor may be provided on a portion of the circuit board protruding into the connection duct.

A lint filter for blocking lint may be disposed in each of the inlet and the outlet.

The dryer may include a waterproof filter disposed on the circuit board to cover the humidity sensor and configured to pass moisture in a gas phase and block water droplets.

The energy harvester may include a cylinder fixed inside the lifter; a coil wound around the cylinder; and a permanent magnet slidably inserted into the cylinder.

The cylinder may be disposed so that a central axis of the cylinder is not parallel to a Y axis passing through a upper surface of the lifter and parallel to a central axis of the rotating drum.

The cylinder may be disposed inclined so that the central axis of the cylinder forms an acute angle with respect to the Y axis on a Y-Z plane.

The cylinder may be disposed so that the central axis of the cylinder forms a right angle with respect to the Y axis on a Y-Z plane.

The cylinder may be disposed inclined so that the central axis of the cylinder forms an acute angle with respect to the Y axis on a X-Y plane.

The cylinder may be disposed so that the central axis of the cylinder forms a right angle with respect to the Y axis on a X-Y plane.

A space may be provided inside the lifter, and a cylinder fixing part for fixing the cylinder and a board fixing part for fixing the circuit board may be provided on an inner surface of the lifter.

The dryer may include a wireless communication part configured to transmit data sensed by the humidity sensor to an outside; and a power supply configured to store the electric power generated by the energy harvester and supply the electric power to the humidity sensor and the wireless communication part. The wireless communication part and the power supply may be mounted on the circuit board.

The energy harvester, the humidity sensor, the circuit board, and the air passage may be formed in a sensing block. The lifter may include a mounting portion in which the sensing block is detachably disposed.

According to another aspect of the disclosure, a dryer may include a rotating drum; a lifter positionable on an inner surface of the rotating drum, the lifter formed to include an accommodation space; an energy harvester including a cylinder positionable in the accommodation space of the lifter so that while the energy harvester is accommodated in the accommodation space, the energy harvester generates power while the rotating drum rotates; a humidity sensor, positionable in the accommodation space of the lifter so that while the humidity sensor is accommodated in the accommodation space, the humidity sensor receives the power generated by the energy harvester and senses humidity; a circuit board, positionable in the accommodation space of the lifter, so that while the circuit board is accommodated in the accommodation space, the humidity sensor is disposed on the circuit board; and an air passage formed through the lifter and guide air inside the rotating drum to pass to the humidity sensor through the lifter. According to an embodiment, the cylinder of the energy harvester is disposed so that a central axis of the cylinder forms a predetermined angle rather than zero (0) degree with respect to a Y axis that passes through an upper surface of the lifter and is parallel to a central axis of the rotating drum.

BRIEF DESCRIPTION OF DRAWINGS

The above and other aspects, features, and advantages of certain embodiments of the present disclosure will be more apparent from the following description taken in conjunction with the accompanying drawings, in which.

DETAILED DESCRIPTION

Various embodiments described below are shown by way of example to assist understanding of the disclosure, and it should be understood that the disclosure may be variously modified and implemented differently from the embodiments described herein. However, in the following description of the disclosure, when it is determined that a detailed description of a related known function or components may unnecessarily obscure the gist of the disclosure, the detailed description and specific illustration thereof will be omitted. Further, in the accompanying drawings, the dimensions of some components may be arbitrarily exaggerated and not drawn to scale in order to aid understanding of the disclosure.

The terms 'first', 'second', etc. may be used to describe diverse components, but the components are not limited by the terms. The terms may only be used to distinguish one component from the others. For example, without departing from the scope of the disclosure, a first component may be referred to as a second component, and similarly, a second component may also be referred to as a first component.

The terms used in embodiments of the disclosure may be construed as commonly known to those skilled in the art unless otherwise defined.

Further, the terms 'leading end', 'rear end', 'upper side', 'lower side', 'top end', 'bottom end', etc. used in the disclosure are defined with reference to the drawings. However, the shape and position of each component are not limited by the terms.

The disclosure has been developed in order to overcome the above noted drawbacks and other problems associated with the conventional arrangement. The disclosure relates to a dryer capable of accurately and conveniently measuring drying degree of an object to be dried with a simple structure.

With a dryer according to an embodiment of the disclosure, a lifter disposed on the inner surface of a rotating drum measures humidity inside the rotating drum and wirelessly transmits humidity data, so that drying degree of an object to be dried inside the rotating drum may be measured accurately and conveniently.

With a dryer according to an embodiment of the disclosure having a lifter with the above structure, because power is generated by an energy harvester as a rotating drum rotates, power may be supplied to a humidity sensor and a wireless communication part provided in the lifter of the rotating drum without a separate power source. Therefore, because a separate power source such as a battery is not required, it may be applied to a high-temperature environment such as the inside of the dryer.

Hereinafter, a dryer according to an embodiment of the disclosure will be described in detail with reference to the accompanying drawings.

Figure 1:
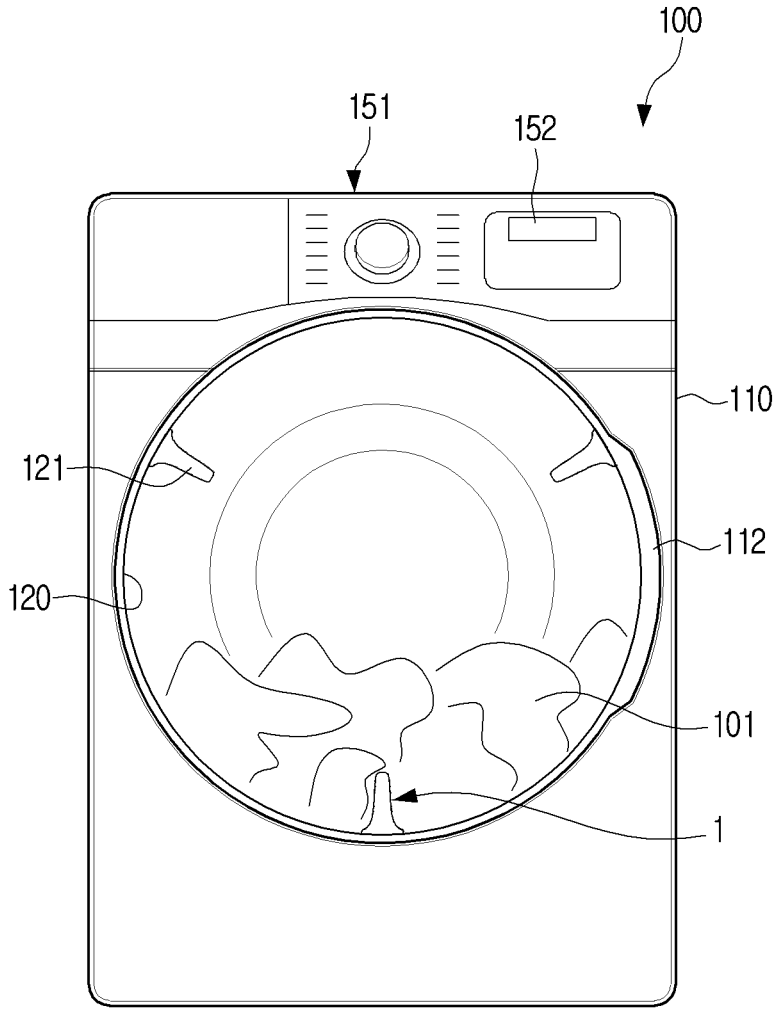
FIG. 1 is a view illustrating a dryer according to an embodiment of the disclosure.
Figure 2:
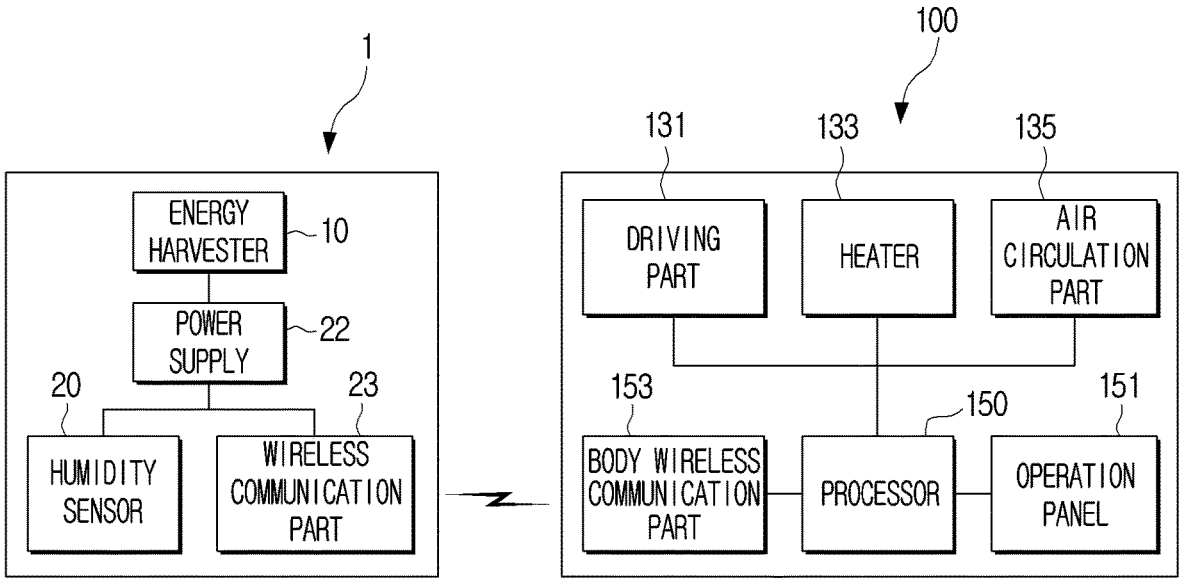
FIG. 2 is a functional block diagram of a sensing device for a dryer and a dryer according to an embodiment of the disclosure.

FIG. 1 is a view illustrating a dryer according to an embodiment of the disclosure. FIG. 2 is a functional block diagram of a sensing device for a dryer and a dryer according to an embodiment of the disclosure.

Referring to FIGS. 1 and 2, a dryer 100 according to an embodiment of the disclosure may include a cabinet 110 and a rotating drum 120.

The cabinet 110 is provided with an input hole through which an object to be dried 101, for example, wet clothes, may be put into and removed from the rotating drum 120. The input hole is opened and closed by a door 112.

The door 112 is hinged on the front surface of the cabinet 110 to open and close the input hole. The door 112 may be formed of a transparent material so that the object to be dried 101 accommodated in the rotating drum 120 may be seen.

An operation panel 151 capable of controlling the dryer 100 is provided on the upper portion of the front surface of the cabinet 110. The operation panel 151 may include a display 152 configured to display the state of the dryer 100. The user may control the dryer by operating the operation panel 151.

The rotating drum 120 is rotatably disposed inside the cabinet 110 and has a hollow cylindrical shape with one end open. The open end of the rotating drum 120 is disposed to communicate with the input hole of the cabinet 110. Accordingly, the object to be dried 101 may be put into or removed from the rotating drum 120 through the input hole of the cabinet 110.

A plurality of lifters 121 and 1 may be provided on the inner surface of the rotating drum 120 to lift the object to be dried 101. At least one lifter 1 among the plurality of lifters 121 and 1 may be formed to measure the internal state of the rotating drum 120.

In the case of this embodiment, the rotating drum 120 is provided with three lifters 121 and 1, and one lifter 1 among the three lifters 121 and 1 is configured to measure humidity, temperature, and the like inside the rotating drum 120. Hereinafter, among the plurality of lifters 121 and 1, the lifter 1 configured to measure humidity, temperature, etc. inside the rotating drum 120 is referred to as a sensing lifter, and will be described later.

A driving part 131 is disposed at the rear end of the rotating drum 120. Therefore, when the driving part 131 operates, the rotating drum 120 rotates.

An air circulation part 135 configured to circulate air through the rotating drum 120 is provided inside the cabinet 110.

In addition, a heater 133 is provided inside the cabinet 110 to heat air circulating by the air circulation part 135.

Therefore, when the air circulation part 135 operates, the air is discharged from the rotating drum 120, passes through the heater 133, and then is supplied to the inside of the rotating drum 120. In other words, medium-temperature and high-humidity air discharged from the rotating drum 120 passes through the air circulation part 135 and the heater 133 to become high-temperature and low-humidity air, and then the high-temperature and low-humidity air is supplied to the rotating drum 120 again. The object to be dried 101 accommodated inside the rotating drum 120 is dried by such air circulation.

At this time, the sensing lifter 1 disposed on the inner surface of the rotating drum 120 may be formed to measure humidity and temperature inside the rotating drum 120 and transmit the measured data to a processor 150 of the dryer 100 provided in the cabinet 110. At the same time, the sensing lifter 1 may perform a function of lifting the object to be dried 101 like the other lifters 121.

In addition, when the rotating drum 120 rotates, the sensing lifter 1 disposed on the inner surface of the rotating drum 120 may generate electric power using an energy harvester 10. The power generated by the energy harvester 10 may be supplied to a humidity sensor 20 and a wireless communication part 23.

The detailed structure and operation of the sensing lifter 1 disposed on the rotating drum 120 will be described later.

In addition, a body wireless communication part 153 capable of wirelessly communicating with the sensing lifter 1 is provided inside the cabinet 110. The body wireless communication part 153 is configured to correspond to the wireless communication part 23 of the sensing lifter 1. For example, the body wireless communication part 153 may be configured to implement any one of communication standards such as Bluetooth, WiFi, Zig bee, Z-wave, and the like.

The processor 150 configured to control the dryer 100 may be provided inside the cabinet 110.

The processor 150 may control each component of dryer 100. In detail, the processor 150 may control the driving part 131, the heater 133, the air circulation part 135, the operation panel 151, and the like so as to operate the dryer 100.

In addition, the processor 150 may receive measurement data from the sensing lifter 1 of the rotating drum 120 and display the received measurement data on the display 152 of the operation panel 151. Further, the processor 150 may control the dryer 100 based on the received measurement data. For example, the processor 150 may control the body wireless communication part 153 to obtain humidity information inside the rotating drum 120, for example, humidity data inside the rotating drum 120 measured by the humidity sensor 20 through the wireless communication part 23 of the sensing lifter 1, and then may control the heater 133 and the air circulation part 135 of the dryer 100 based on the received humidity data.

The processor 150 may include, for example, a processing circuit such as a printed circuit board, various electronic components such as ASIC, ROM, RAM, etc. and/or program modules. The process of the processor 150 controlling the dryer 100 to dry the object to be dried 101 is the same as or similar to that of the dryer of the prior art; therefore, a detailed description of the configuration of the processor 150 is omitted.

Hereinafter, a lifter used in the dryer 100 according to an embodiment of the disclosure and capable of measuring a state inside the rotating drum 120, that is, the sensing lifter 1 will be described in detail with reference to FIGS. 3 to 7.

Figure 3:
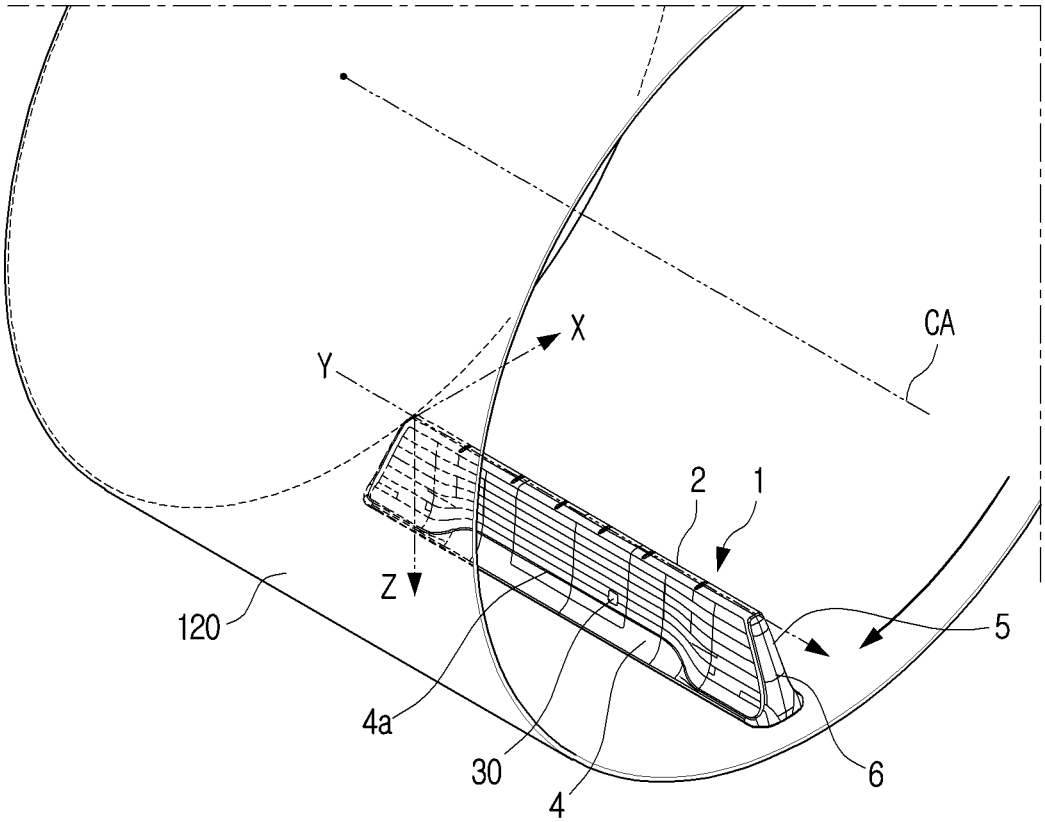
FIG. 3 is a perspective view illustrating a rotating drum in which a lifter of a dryer is disposed according to an embodiment of the disclosure.
Figure 4:
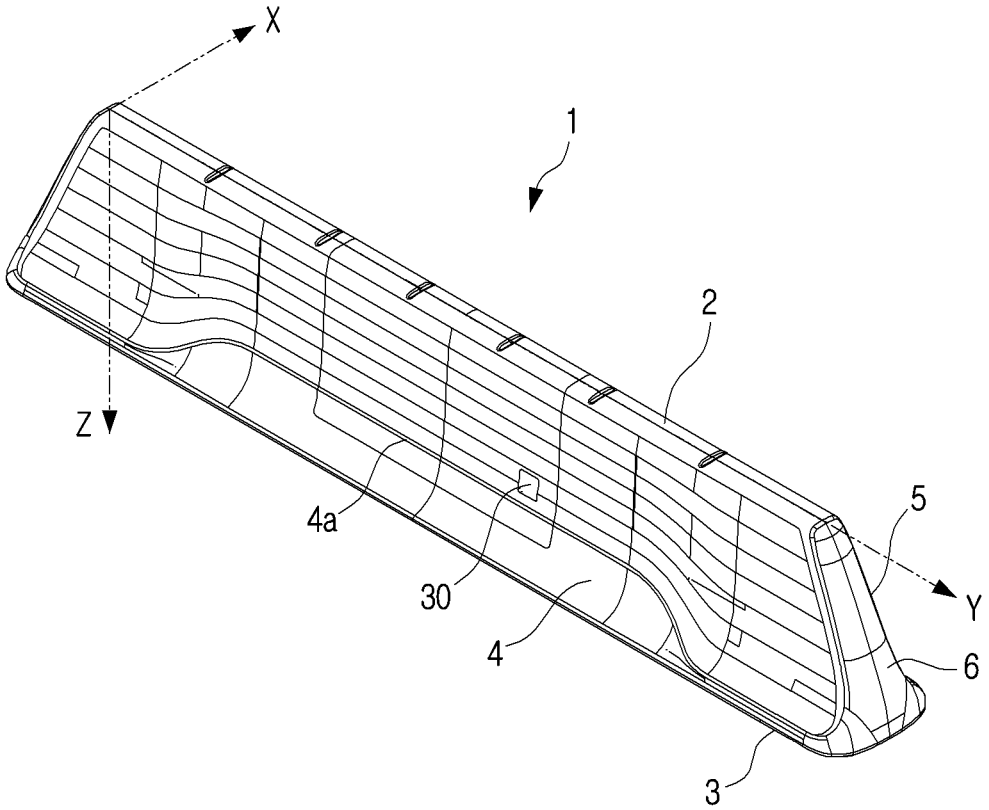
FIG. 4 is a perspective view illustrating a lifter of a dryer according to an embodiment of the disclosure.
Figure 5:
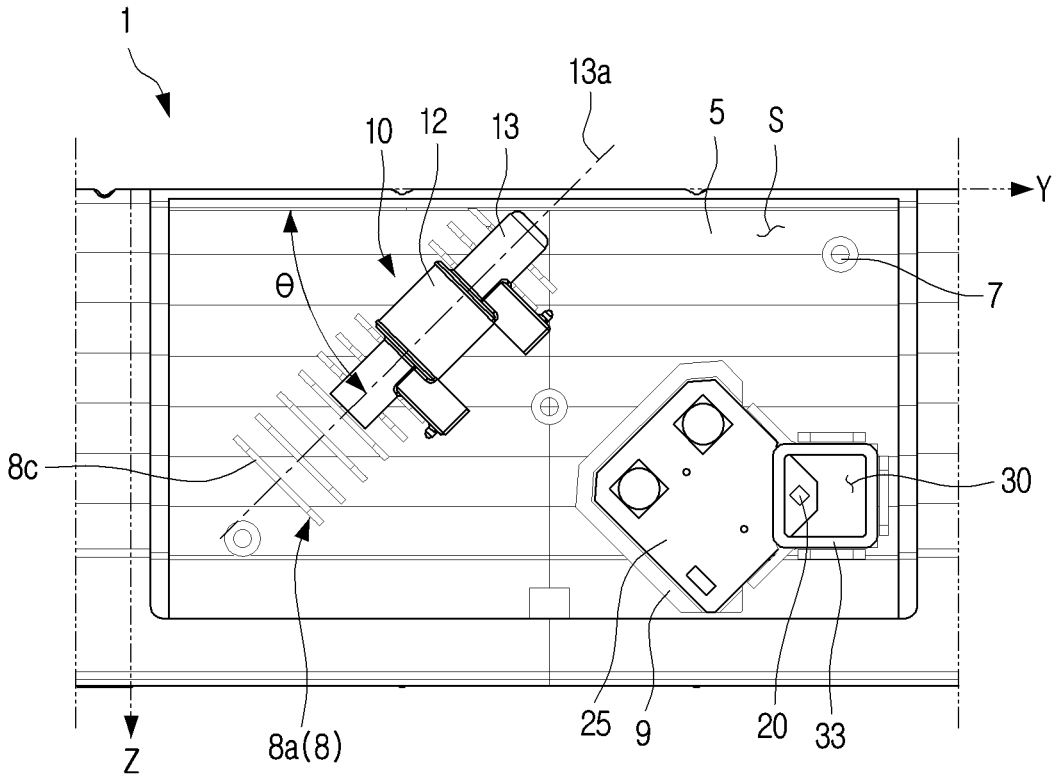
FIG. 5 is a front view illustrating a lifter according to an embodiment of the disclosure with one surface removed.
Figure 6:
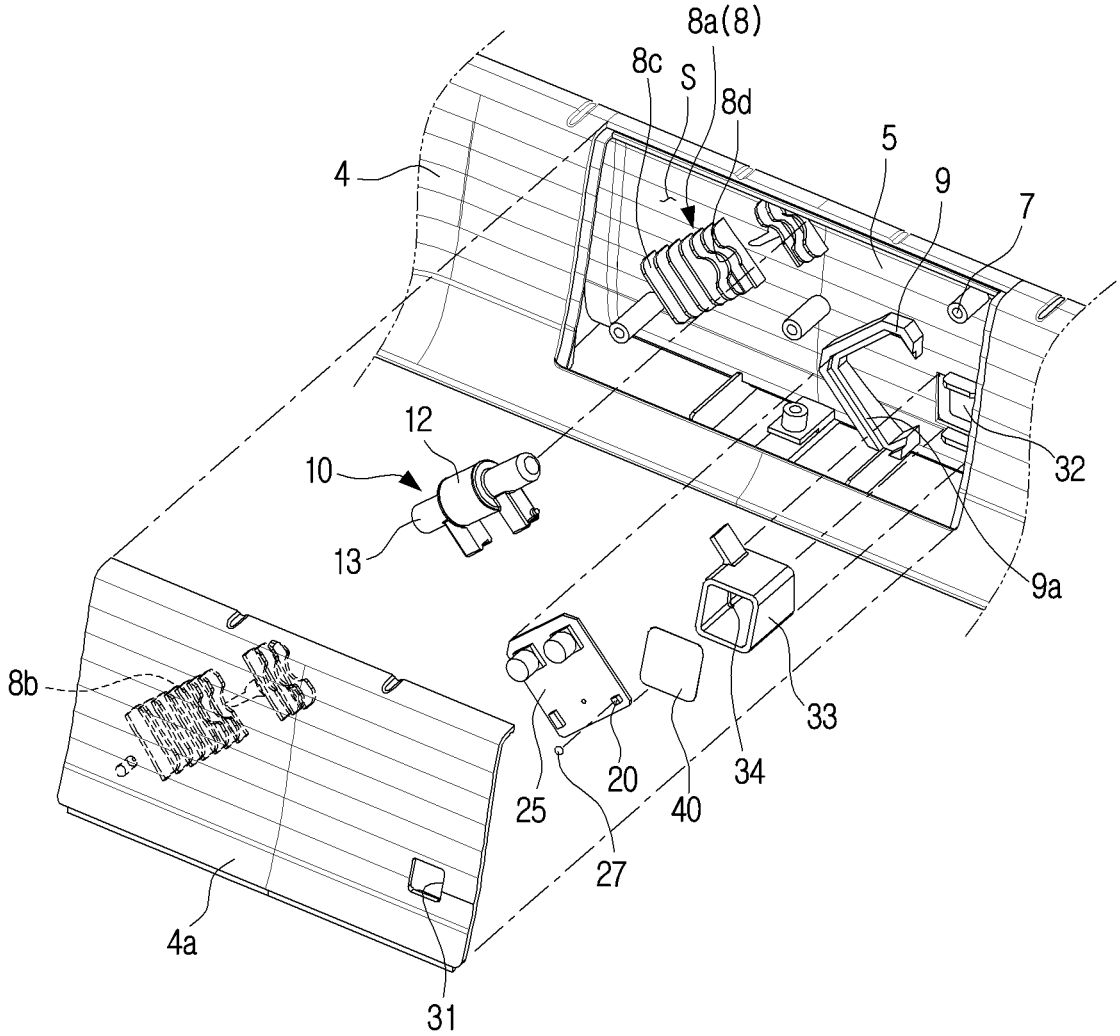
FIG. 6 is an exploded perspective view illustrating a lifter according to an embodiment of the disclosure.
Figure 7:
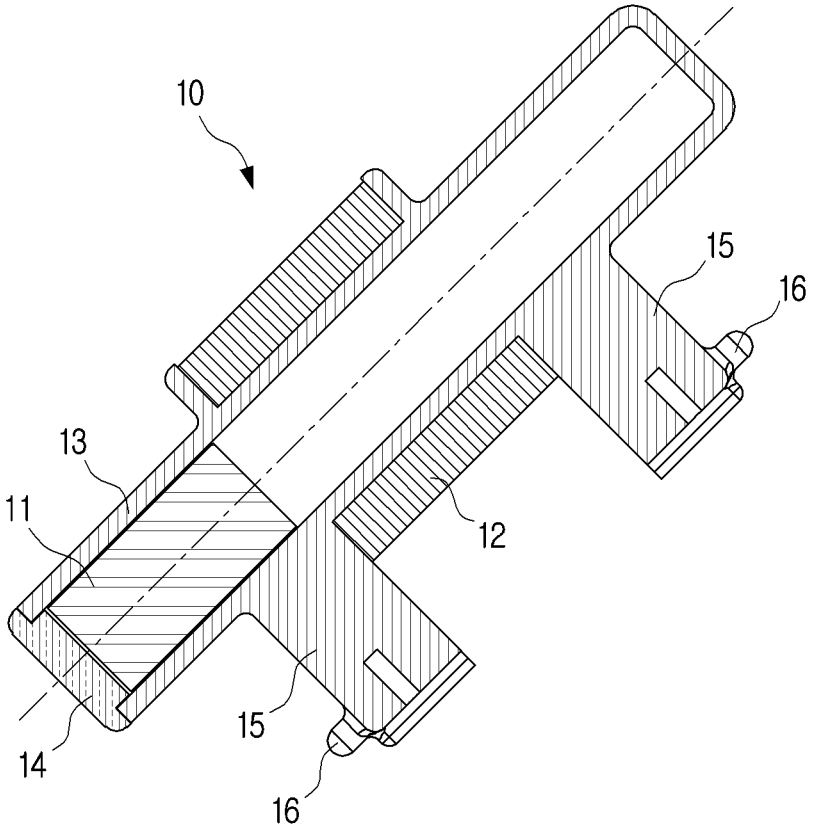
FIG. 7 is a cross-sectional view illustrating an energy harvester of the lifter of FIG. 6.

FIG. 3 is a perspective view illustrating a rotating drum in which a lifter of a dryer according to an embodiment of the disclosure is disposed. FIG. 4 is a perspective view illustrating a lifter of a dryer according to an embodiment of the disclosure. FIG. 5 is a front view illustrating a lifter according to an embodiment of the disclosure with one surface removed. FIG. 6 is an exploded perspective view illustrating a lifter according to an embodiment of the disclosure, and FIG. 7 is a cross-sectional view illustrating an energy harvester of the lifter of FIG. 6.

Referring to FIG. 3, the sensing lifter 1 used in the dryer 100 according to an embodiment of the disclosure is disposed on the inner surface of the rotating drum 120.

The sensing lifter 1 is disposed on the inner surface of the rotating drum 120 in the longitudinal direction of the rotating drum 120 like general lifters 121 disposed on the rotating drum 120, that is, the lifters 121 that cannot detect the state inside the rotating drum 120. The sensing lifter 1 is formed to have a length corresponding to the length of the rotating drum 120.

In addition, the sensing lifter 1 may be formed in the same shape as the general lifter 121. For example, as illustrated in FIGS. 3 and 4, the sensing lifter 1 may be formed in a block having a substantially isosceles trapezoidal cross-section. In detail, the sensing lifter 1 may be formed so that the lower surface 3 fixed to the rotating drum 120 has a wider width than the upper surface 2. Both side surfaces 6 of the sensing lifter 1 may be inclined toward the upper surface 2. Therefore, the length of the upper surface 2 of the sensing lifter 1 is shorter than the length of the lower surface 3.

However, the shape of the sensing lifter 1 is not limited thereto. The sensing lifter 1 may be formed in various shapes as long as it can lift the object to be dried 101 accommodated inside the rotating drum 120.

The sensing lifter 1 may include the energy harvester 10, the humidity sensor 20, a circuit board 25, and an air passage 30.

A space S may be formed inside the sensing lifter 1. The inner space S of the sensing lifter 1 may be sealed by the front surface 4, the rear surface 5, both side surfaces 6, the upper surface 2, and the lower surface 3. The inner space S may be in communication with the inside of the rotating drum 120 through the air passage 30. Thus, air inside the rotating drum 120 may pass through the air passage 30.

The energy harvester 10, the humidity sensor 20, and the circuit board 25 may be disposed in the above-described inner space S of the sensing lifter 1. To this end, a portion 4*a* of the front surface 4 of the sensing lifter 1 may be detachably disposed on the front surface 4. In other words, the portion 4*a* of the front surface 4 of the sensing lifter 1 may be formed as a cover capable of opening and closing the inner space S of the sensing lifter 1.

Referring to FIGS. 5 and 6, a plurality of fixing parts 7 may be provided on the inner side of the rear surface 5 of the sensing lifter 1 to fix the portion 4*a* of the front surface 4, that is, the cover.

The energy harvester 10 is disposed inside the sensing lifter 1 and is configured to generate electric power when the rotating drum 120 rotates. In other words, the energy harvester 10 is configured to convert rotation of the rotating drum 120 of the dryer 100 into electricity.

To this end, the energy harvester 10 is configured to generate electric power using a permanent magnet 11 and a coil 12.

Referring to FIGS. 5 and 7, the energy harvester 10 may include a cylinder 13, the coil 12, and the permanent magnet 11.

The cylinder 13 is formed in a hollow cylindrical shape and may be fixed to the inner space S of the sensing lifter 1. One end of the cylinder 13 is blocked, and a cap 14 is detachably disposed at the other end of the cylinder 13.

A pair of protrusions 15 may be provided on the side surface of the cylinder 13 at a predetermined interval. Terminals 16 electrically connected to both ends of the coil 12 are disposed on the pair of protrusions 15.

A cylinder fixing part 8 may be provided on the inner surface of the sensing lifter 1 to fix the cylinder 13. The cylinder fixing part 8 may include a first cylinder fixing part 8*a* and a second cylinder fixing part 8*b*.

In detail, the first cylinder fixing part 8*a* formed to accommodate approximately half of the cylinder 13 in the radial direction of the cylinder 13 may be provided on the inner side of the rear surface 5 of the sensing lifter 1, and the second cylinder fixing part 8*b* formed to accommodate the other half of the cylinder 13 in the radial direction thereof may be provided on the inner side of the portion 4*a* of the front surface 4 of the sensing lifter 1.

Therefore, when the cylinder 13 is accommodated in the first cylinder fixing part 8*a* of the rear surface 5 of the sensing lifter 1 and covered with the portion 4*a* of the front surface 4 of the sensing lifter 1, the cylinder 13 is fixed between the first cylinder fixing part 8*a* and the second cylinder fixing part 8*b*.

Each of the first cylinder fixing part 8*a* and the second cylinder fixing part 8*b* may be formed in a plurality of ribs 8*c* arranged side by side at regular intervals. A groove 8*d* corresponding to the semicircle of the cylinder 13 is formed at an upper end of each of some of the plurality of ribs 8*c*.

Therefore, when the upper ends of the plurality of ribs 8*c* of the first cylinder fixing part 8*a* and the upper ends of the plurality of ribs 8*c* of the second cylinder fixing part 8*b* are in contact with or adjacent to each other, a circular groove capable of fixing the cylinder 13 may be formed between the first cylinder fixing part 8*a* and the second cylinder fixing part 8*b*.

The plurality of ribs 8*c* disposed on the inner surface of the front surface 4 and the plurality of ribs 8*c* disposed on the inner surface of the rear surface 5 of the sensing lifter 1 may perform a function of reinforcing the strength of the sensing lifter 1.

The coil 12 is provided around the cylinder 13. In other words, the coil 12 is disposed at the central portion of the cylinder 13, that is, between the pair of protrusions 15, and is provided to surround the outer circumferential surface of the cylinder 13. As another example, the coil 12 may be provided on the inner circumferential surface of the cylinder 13.

The permanent magnet 11 may be disposed inside the cylinder 13. In detail, the permanent magnet 11 is inserted into the cylinder 13 and provided to be movable along the cylinder 13 inside the cylinder 13. In other words, the permanent magnet 11 is formed in a cylindrical shape having an outer diameter smaller than the inner diameter of the cylinder 13. When the permanent magnet 11 passes through the coil 12 while sliding along the cylinder 13 inside the cylinder 13, electric power may be generated in the coil 12.

The coil 12 is electrically connected to the power supply 22. For example, both ends of the coil 12 are connected to the terminals 16 provided on the pair of protrusions 15 of the cylinder 13, and the terminals 16 and the power supply 22 may be connected with wires.

The power supply 22 is configured to store power generated by the energy harvester 10 and to supply the stored power to the humidity sensor 20 and the wireless communication part 23. The power supply 22 may include a power conversion part that converts the stored power into a form of power required by the humidity sensor 20 and the wireless communication part 23.

On the other hand, when the permanent magnet 11 is completely out of the coil 12, the power output of the coil 12 is maximized. Therefore, the length of the cylinder 13 in which the permanent magnet 11 moves may be three times or more than the width of the coil 12 wound around the cylinder 13. Accordingly, when the permanent magnet 11 is on the left side of the cylinder 13, the right end of the permanent magnet 11 is spaced apart from the coil 12. Also, when the permanent magnet 11 is on the right side of the cylinder 13, the left end of the permanent magnet 11 is spaced apart from the coil 12.

In the case of forming the energy harvester 10 with the structure shown in FIG. 7, when the rotating drum 120 rotates, the permanent magnet 11 moves inside the cylinder 13 and passes through the coil 12, so that the energy harvester 10 may generate power. In other words, the energy harvester 10 of the sensing lifter 1 may convert rotation of the rotating drum 120 of the dryer 100 into electric power.

The relationship between the rotating drum 120 and the arrangement of the energy harvester 10 disposed inside the sensing lifter 1 will be described later.

The humidity sensor 20 is disposed in the inner space S of the lifter 1 and is configured to receive power generated by the energy harvester 10 and sense humidity inside the rotating drum 120.

The humidity sensor 20 is configured to measure the humidity of air. The humidity sensor 20 is disposed in the sensing lifter 1 so that the humidity sensor 20 contacts the outside air passing through the air passage 30 provided in the sensing lifter 1, that is, the air inside the rotating drum 120 so as to measure the humidity of the air. To this end, the humidity sensor 20 may be disposed in the air passage 30 of the sensing lifter 1 formed to allow outside air to pass through.

The humidity sensor 20 may be disposed on the circuit board 25. The humidity sensor 20 may be mounted on a corner of the circuit board 25. The circuit board 25 may be implemented as a printed circuit board.

In addition, a waterproof filter 27 may be provided above the humidity sensor 20 to prevent water droplets introduced into the air passage 30 from directly contacting the humidity sensor 20. For example, the waterproof filter 27 is disposed on the circuit board 25 so as to cover the humidity sensor 20. The waterproof filter 27 may be formed to pass moisture in the gas phase contained the air and block water droplets. For example, the waterproof filter 27 may be formed of a porous member having a large mesh number.

The circuit board 25 may be fixed by the sensing lifter 1. For example, the circuit board 25 may be fixed so as not to move in the inner space S of the sensing lifter 1.

To this end, a board fixing part 9 for fixing the circuit board 25 may be provided inside the sensing lifter 1. In detail, the board fixing part 9 including a seating portion 9*a* capable of accommodating and fixing the circuit board 25 may be provided on the inner side of the rear surface 5 of the sensing lifter 1.

The board fixing part 9 may be provided adjacent to an outlet 32 of the rear surface 5 of the sensing lifter 1. Therefore, when the circuit board 25 is disposed on the board fixing part 9, the corner of the circuit board 25 where the humidity sensor 20 is installed may be located above the outlet 32.

In addition, the circuit board 25 may include the wireless communication part 23 and the power supply 22.

The wireless communication part 23 may be configured to transmit humidity data sensed by the humidity sensor 20 to the outside. In detail, the wireless communication part 23 is configured to receive a signal output from the humidity sensor 20, that is, humidity data of the air inside the rotating drum 120, and wirelessly transmit the signal to the outside of the sensing lifter 1. Accordingly, the humidity inside the rotating drum 120 may be measured by the humidity sensor 20 and transmitted to the processor 150 of the dryer 100 or the outside of the dryer 100 through the wireless communication part 23.

The wireless communication part 23 may be implemented as a communication module configured to wirelessly transmit data sensed by the humidity sensor 20 to the outside. The wireless communication part 23 may be implemented as a communication module corresponding to the body wireless communication part 153.

The wireless communication part 23 may be configured to satisfy various communication standards. For example, the wireless communication part 23 may be implemented with Bluetooth. As another example, the wireless communication part 23 may be configured to implement a communication standard such as WiFi, Zig-bee, Z-wave, or the like.

The power supply 22 may be configured to store power generated by the energy harvester 10 and supply power to the humidity sensor 20 and the wireless communication part 23.

As illustrated in FIG. 5, the energy harvester 10 may be disposed on one side of the circuit board 25. Accordingly, the coil 12 wound around the outer circumferential surface of the cylinder 13 of the energy harvester 10 is electrically connected to the power supply 22 provided on the circuit board 25. Therefore, power generated by the energy harvester 10 may be stored in the power supply 22.

In this embodiment, only the humidity sensor 20 for measuring the humidity of the outside air is disposed on the circuit board 25. However, as another embodiment, when it is necessary to measure temperature inside the rotating drum 120 with the sensing lifter 1, a temperature sensor may be mounted on the circuit board 25. At this time, the temperature sensor may be disposed to position in the air passage 30 like the humidity sensor 20.

The air passage 30 is formed to pass through the sensing lifter 1 and to allow air inside the rotating drum 120 to pass through the air passage 30. In other words, the air passage 30 is formed to communicate the front surface 4 and the rear surface 5 of the sensing lifter 1. Thus, air around the front surface 4 of the sensing lifter 1 may move to the rear surface 5 of the sensing lifter 1 through the air passage 30.

In addition, air around the rear surface 5 of the sensing lifter 1 may move to the front surface 4 of the sensing lifter 1 through the air passage 30.

The air passage 30 may include the inlet 31 formed on the front surface 4 of the sensing lifter 1 and the outlet 32 formed on the rear surface 5 of the sensing lifter 1. Then, the air inside the rotating drum 120 is introduced into the inner space S of the sensing lifter 1 through the inlet 31, and the air is discharged from the inner space S of the sensing lifter 1 to the outside of the sensing lifter 1 through the outlet 32.

A lint filter 40 may be disposed at the inlet 31 and the outlet 32 to block foreign substances such as lint. In other words, the lint filter 40 may be disposed on the front surface 4 of the sensing lifter 1 to cover the inlet 31 formed on the front surface 4 of the sensing lifter 1. In addition, the lint filter 40 may be disposed on the rear surface 5 of the sensing lifter 1 to cover the outlet 32 formed on the rear surface 5 of the sensing lifter 1.

The lint filter 40 may be formed of a material capable of passing air inside the rotating drum 120 and blocking foreign substances such as lint. For example, the lint filter 40 may be formed of polybutylene terephthalate (PBT).

The air passage 30 may include a connection duct 33 formed to connect the inlet 31 and the outlet 32 and to allow air inside the rotating drum 120 to pass through.

When the connection duct 33 is provided between the inlet 31 and the outlet 32, the air introduced through the inlet 31 may pass through the connection duct 33, and then may be directly discharged to the outside through the outlet 32 without flowing into the inner space S of the sensing lifter 1. In other words, the connection duct 33 may divide the inner space S of the sensing lifter 1 and the air passage 30 to block outside air from entering the inner space S of the sensing lifter 1.

The humidity sensor 20 may be positioned inside the connection duct 33. To this end, a slot 34 into which the corner portion of the circuit board 25 is inserted may be provided in the connection duct 33. The humidity sensor 20 may be disposed at the corner portion of the circuit board 25 protruding into the connection duct 33 through the slot 34.

Then, outside air introduced into the connection duct 33 through the inlet 31, that is, the air inside the rotating drum 120 may come into contact with the humidity sensor 20, and then may be discharged to the rotating drum 120 through the outlet 32.

Because the sensing lifter 1 moves together with the rotating drum 120, the air entering the air passage 30 of the sensing lifter 1 has a certain flow rate. When the area of the air passage 30 through which air flows into the inner space S of the sensing lifter 1 is large, the humidity sensor 20 comes into contact with a large amount of air, so that a time delay occurs in tracking the change in humidity in the rotating drum 120. Then, the processor 150 of the dryer 100 may identify the drying completion of the object to be dried 101 late, so that the object to be dried 101 may be damaged or energy may be wasted.

Therefore, in order to minimize delay in the time when the humidity sensor 20 inside the sensing lifter 1 measures the humidity and outputs a signal, the area of the air passage 30 may be as small as possible.

Accordingly, as in the this embodiment, when the inner space S of the sensing lifter 1 and the air passage 30 of the sensing lifter 1 are partitioned by the connection duct 33 and the humidity sensor 20 is disposed inside the connection duct 33, the area of the air passage 30 is narrowed, so that signal delay of the humidity sensor 20 may be minimized.

In the above description, the energy harvester 10, the humidity sensor 20, and the circuit board 25 are formed integrally with the lifter 1. However, as another embodiment, as illustrated in FIG. 8, the energy harvester 10, the humidity sensor 20, and the circuit board 25 may be formed in a separate type.

Figure 8:
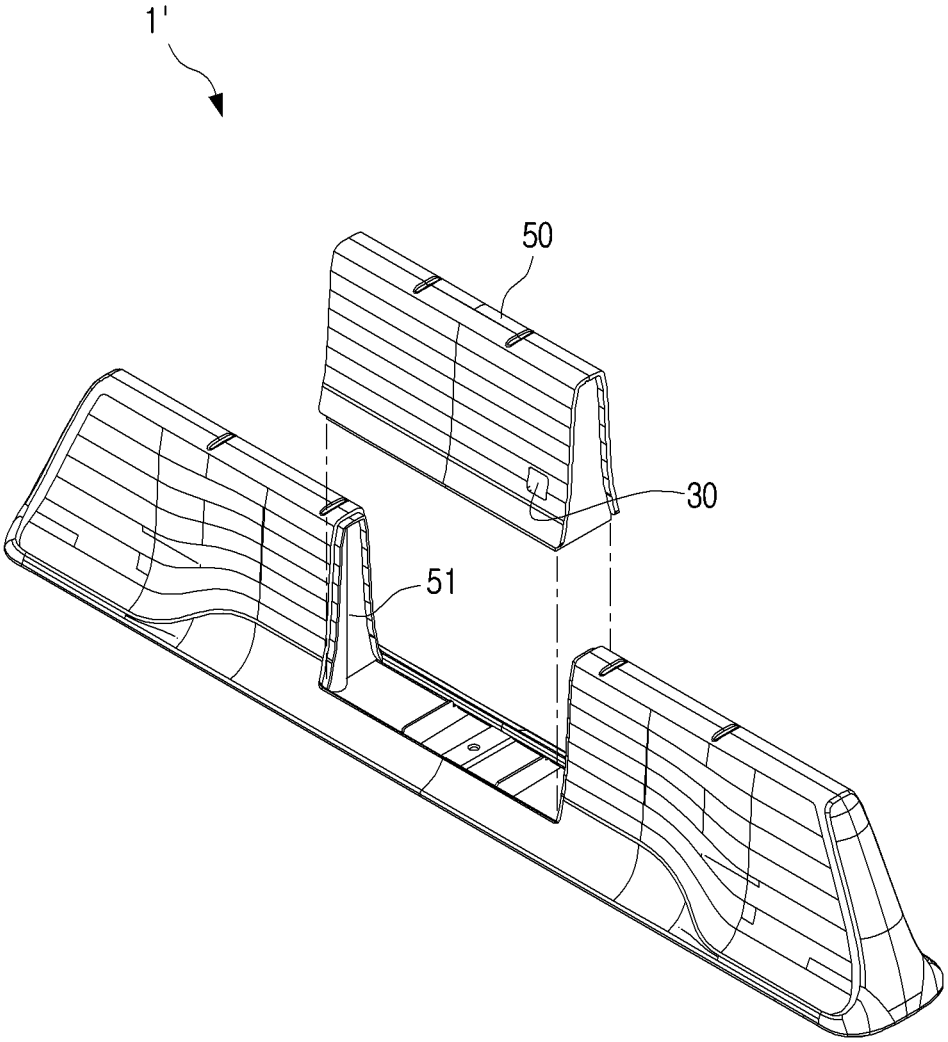
FIG. 8 is a perspective view illustrating a sensing lifter according to another embodiment of the disclosure.

FIG. 8 is a perspective view illustrating a sensing lifter according to another embodiment of the disclosure.

Referring to FIG. 8, a sensing block 50 may be formed in a structure in that the sensing block 50 is detachably coupled to the sensing lifter 1', and the energy harvester 10, the humidity sensor 20, the circuit board 25, and the air passage 30 as described above may be provided inside the sensing block 50. In this case, the sensing lifter 1' may include a mounting portion 51 to which the sensing block 50 may be attached or detached.

In this way, when the sensing block 50 is formed in a separate type, there is an advantage in that maintenance of the sensing lifter 1' is convenient. For example, when the humidity sensor 20 or the circuit board 25 is out of order, the sensing block 50 may be easily replaced from the sensing lifter 1' fixed to the inner surface of the rotating drum 120.

In the case of this embodiment, in order to for the energy harvester 10 to generate electric power by the rotation of the rotating drum 120, the cylinder 13 of the energy harvester 10 may be arranged so that the central axis 13*a* of the cylinder 13 is not parallel to the Y axis that passes through the upper surface 2 of the lifter 1 and is parallel to the central axis CA of the rotating drum 120. In other words, the cylinder 13 may be arranged inside the sensing lifter 1 such that the central axis 13*a* of the cylinder 13 forms a predetermined angle θ with the Y axis instead of zero degrees.

When the cylinder 13 is disposed in this way, the permanent magnet 11 located inside the cylinder 13 of the energy harvester 10 passes through the coil 12 while moving up and down along the cylinder 13, so the coil 12 may generate power.

Hereinafter, various installation directions of the energy harvester 10 of the sensing lifter 1 according to an embodiment of the disclosure will be described in detail with reference to FIGS. 9A, 9B, 10, 11A, 11B, 12A, 12B, 13A, 13B, 14A-14C.

In FIGS. 3 and 9A, 9B, 10, 11A, 11B, 12A, 12B, 13A, 13B, 14A-14C described below, the Y axis represents a straight line passing through the upper surface 2 of the lifter 1 and parallel to the central axis CA of the rotating drum 120. In this case, the Y axis may be defined as a straight line bisecting the upper surface 2 of the lifter 1 in the width direction. The Z axis represents a straight line that is perpendicular to the Y axis and directed from the upper surface 2 to the lower surface 3 of the lifter 1. The X axis represents a straight line that is perpendicular to the Y axis and the Z axis and directed from the front surface 4 to the rear surface 5 of the lifter 1.

Figure 9A:
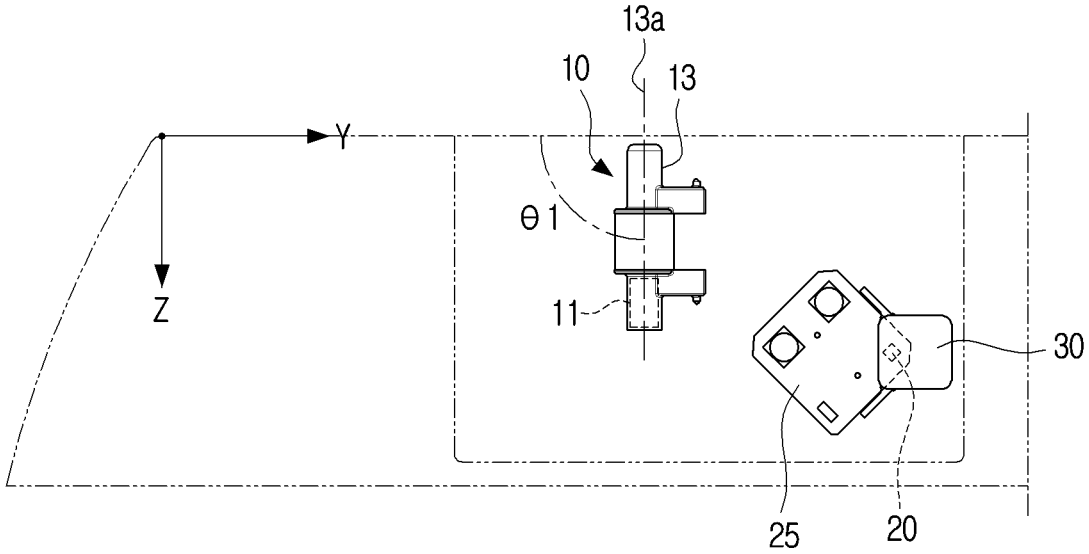
FIGS. 9A and 9B are a partial front view and a partial plan view illustrating a lifter in which a cylinder of an energy harvester is disposed perpendicularly to the Y-axis in the Y-Z plane.
Figure 9B:
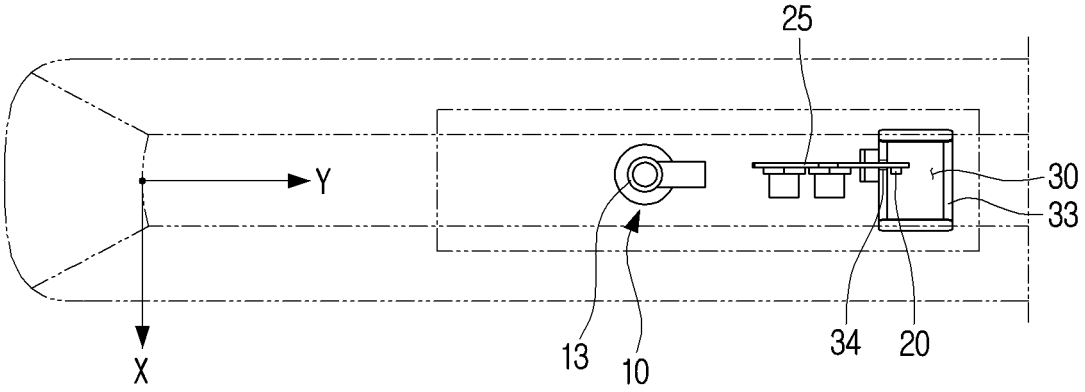

FIGS. 9*a* and 9*b* are a partial front view and a partial plan view illustrating a lifter in which a cylinder of an energy harvester is disposed perpendicularly to the Y-axis in the Y-Z plane. For reference, in FIGS. 9*a* and 9*b*, the lifter 1 is indicated by a virtual line to clearly show the arrangement of the cylinder 13 of the energy harvester 10.

Referring to FIGS. 9*a* and 9*b*, the cylinder 13 of the energy harvester 10 is arranged such that the central axis 13*a* of the cylinder 13 is located on the Y-Z plane and forms a right angle θ1 with respect to the Y axis. As illustrated in FIG. 9*a*, the cylinder 13 is disposed perpendicular to the Y axis and parallel to the Z axis. Then, one end of the circular cylinder 13 is visible on the X-Y plane as illustrated in FIG. 9*b*.

In this case, the permanent magnet 11 accommodated inside the cylinder 13 is located at the lower end of the cylinder 13. Therefore, when the rotating drum 120 rotates, the sensing lifter 1 disposed inside the rotating drum 120 rotates together with the rotating drum 120. Then, because the permanent magnet 11 of the energy harvester 10 inside the sensing lifter 1 passes through the coil 12 while moving up and down along the cylinder 13, electric power is generated.

Hereinafter, the movement of the permanent magnet 11 of the energy harvester 10 when the rotating drum 120 rotates will be described in detail with reference to FIG. 10.

Figure 10:
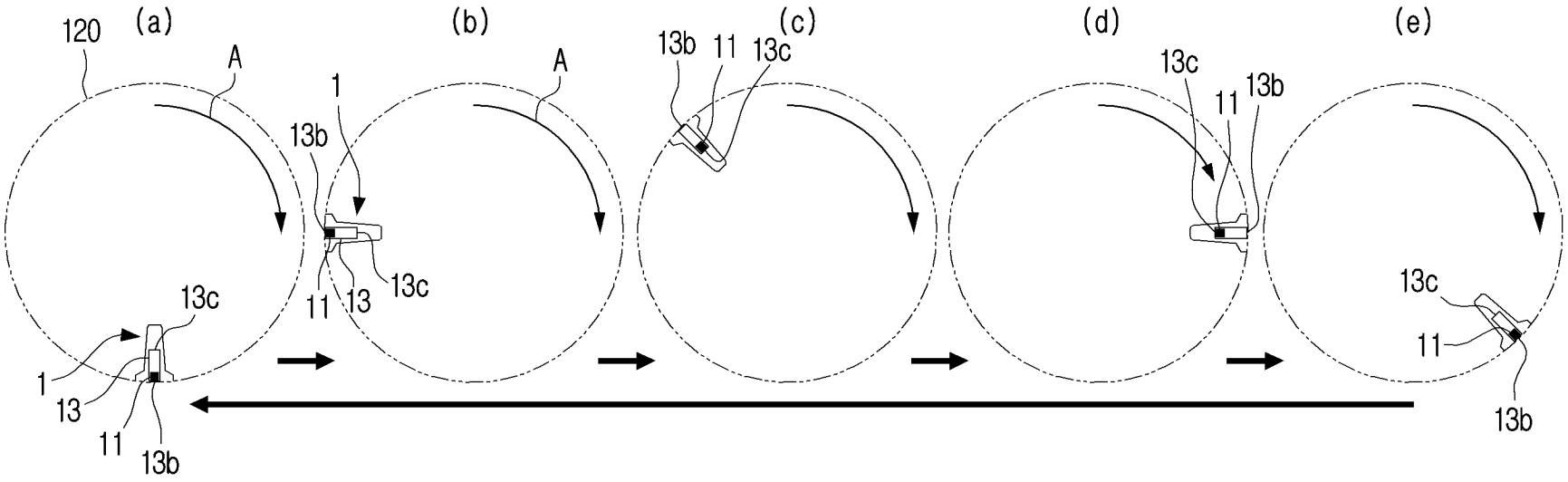
FIG. 10 is a view for explaining movement of a permanent magnet of an energy harvester by rotation of a rotating drum in a dryer according to an embodiment of the disclosure.

FIG. 10 is a view for explaining movement of a permanent magnet of an energy harvester by rotation of a rotating drum in a dryer according to an embodiment of the disclosure. In FIG. 10, the cylinder 13 is arranged so that the central axis 13*a* of the cylinder 13 is located on the Y-Z plane and forms a right angle to the Y axis. For reference, in FIG. 10, the sensing lifter 1 and the cylinder 13 and the permanent magnet 11 of the energy harvester 10 are briefly illustrated for convenience of illustration.

In the case shown in (a) of FIG. 10, the sensing lifter 1 is positioned at the lowest point of the rotating drum 120. At this time, the cylinder 13 of the energy harvester 10 is in a vertical state, and the permanent magnet 11 is located at the lower end 13*b* of the cylinder 13.

In this state, when the rotating drum 120 rotates 90 degrees in the clockwise direction (arrow A), the cylinder 13 of the energy harvester 10 is in a horizontal state, as illustrated in (b) of FIG. 10. Until this time, the upper end 13*c* of the cylinder 13 remains higher than the lower end 13*b* thereof; therefore, the permanent magnet 11 is located at the lower end 13*b* of the cylinder 13 as it is.

In this state, when the rotating drum 120 continues to rotate in the clockwise direction, the cylinder 13 of the energy harvester 10 is inclined so that the lower end 13*b* of the cylinder 13 is located higher than the upper end 13*c* of the cylinder 13. Then, the permanent magnet 11 located at the lower end 13*b* of the cylinder 13 moves along the cylinder 13 toward the upper end 13*c* of the cylinder 13.

As illustrated in (c) of FIG. 10, when the rotating drum 120 continues to rotate until approximately 135 degrees, the lower end 13*b* of the cylinder 13 of the energy harvester 10 maintains a higher state than the upper end 13*c* of the cylinder 13, so that the permanent magnet 11 moves along the cylinder 13 and is positioned at the upper end 13*c* of the cylinder 13.

In this state, when the rotating drum 120 continues to rotate in the clockwise direction (arrow A) until 270 degrees, as illustrated in (d) of FIG. 10, the cylinder 13 of the energy harvester 10 is in a horizontal state. Until this time, the lower end 13*b* of the cylinder 13 remains higher than the upper end 13*c*, so that the permanent magnet 11 is located at the upper end 13*c* of the cylinder 13 as it is.

In this state, when the rotating drum 120 continues to rotate in the clockwise direction, the cylinder 13 of the energy harvester 10 is inclined, so that the upper end 13*c* of the cylinder 13 is located higher than the lower end 13*b* of the cylinder 13. Then, the permanent magnet 11 located at the upper end 13*c* of the cylinder 13 moves along the cylinder 13 toward the lower end 13*b* of the cylinder 13.

As illustrated in (e) of FIG. 10, when the rotating drum 120 continues to rotate until approximately 315 degrees, the upper end 13*c* of the cylinder 13 of the energy harvester 10 maintains a higher state than the lower end 13*b* of the cylinder 13, so that the permanent magnet 11 is positioned at the lower end 13*b* of the cylinder 13.

In this state, when the rotating drum 120 continues to rotate in the clockwise direction (arrow A) until 360 degrees, as illustrated in (a) of FIG. 10, the cylinder 13 of the energy harvester 10 becomes in a vertical state. Until this time, the lower end 13*b* of the cylinder 13 remains lower than the upper end 13*c*, so that the permanent magnet 11 is located at the lower end 13*b* of the cylinder 13 as it is.

In this way, when the rotating drum 120 rotates once, that is, when the sensing lifter 1 rotates 360 degrees together with the rotating drum 120, the permanent magnet 11 of the energy harvester 10 passes through the coil 12 provided in the center of the cylinder 13 twice. In other words, the permanent magnet 11 of the energy harvester 10 may pass through the coil 12 wound around the center of the cylinder 13 twice in one rotation of the rotating drum 120. When the permanent magnet 11 passes through the coil 12 in this way, power is generated in the coil 12.

By the rotation of the rotating drum 120, the permanent magnet 11 of the energy harvester 10 of the sensing lifter 1 repeats the operations as in (a) to (e) of FIG. 10. Accordingly, when the rotating drum 120 rotates, power may be generated in the energy harvester 10 of the sensing lifter 1 disposed on the rotating drum 120.

Figure 11A:
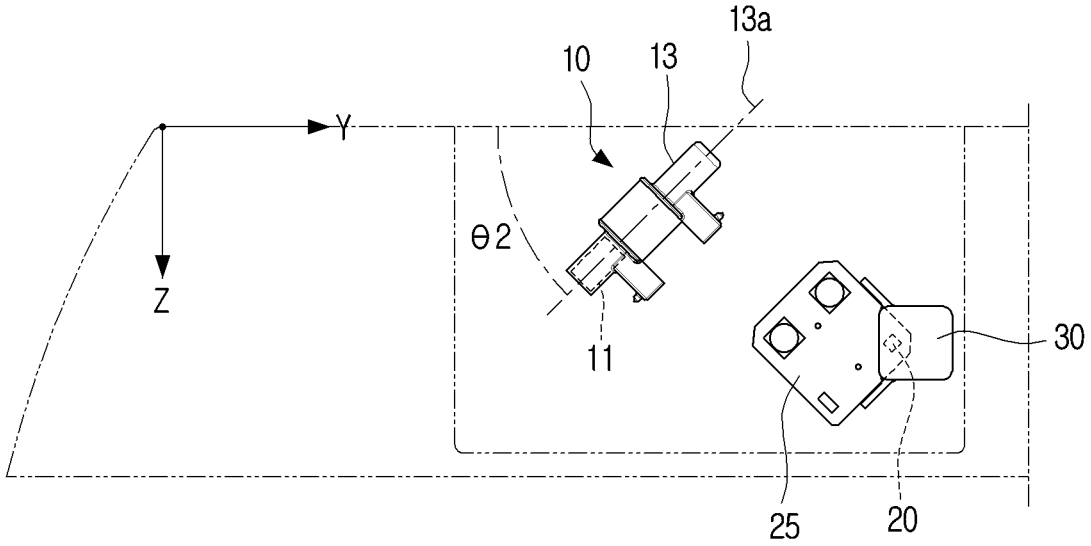
FIGS. 11A and 11B are a partial front view and a partial plan view illustrating a lifter in which a cylinder of an energy harvester is disposed in the Y-Z plane at an angle to the Y-axis.
Figure 11B:
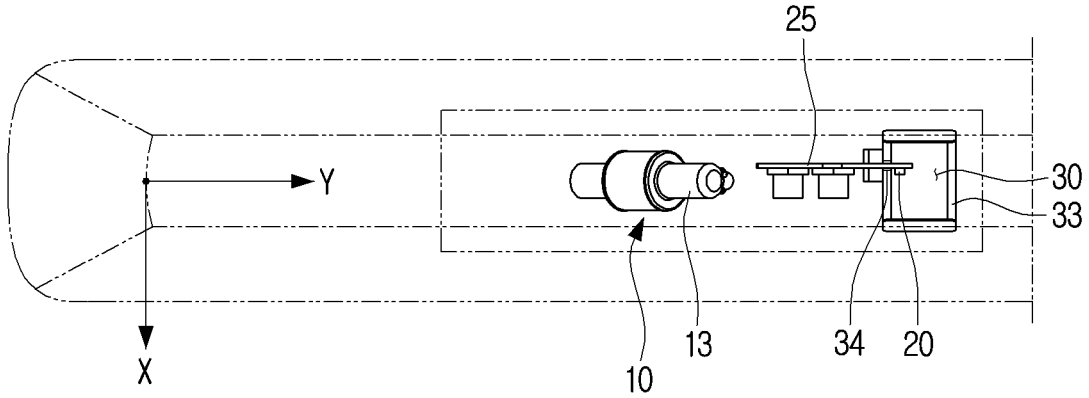

As another example, as illustrated in FIGS. 11*a* and 11*b*, the cylinder 13 of the energy harvester 10 may be disposed inclined so that the central axis 13*a* of the cylinder 13 forms an acute angle θ2 with respect to the Y axis on the Y-Z plane.

FIGS. 11*a* and 11*b* are a partial front view and a partial plan view illustrating a lifter in which a cylinder of an energy harvester is disposed in the Y-Z plane at an angle to the Y-axis. For reference, in FIGS. 11*a* and 11*b*, the lifter 1 is indicated by a virtual line to clearly show the arrangement of the cylinder 13 of the energy harvester 10.

Referring to FIGS. 11*a* and 11*b*, the cylinder 13 of the energy harvester 10 is disposed so that the central axis 13*a* of the cylinder 13 is located on the Y-Z plane and forms a predetermined angle θ2, for example, an acute angle with respect to the Y axis. As illustrated in FIG. 11*a*, the cylinder 13 is inclined at an acute angle with respect to the Y axis, and is inclined at an acute angle with respect to the Z axis. Then, one end and the body of the inclined cylinder 13 are visible on the X-Y plane as illustrated in FIG. 11*b*.

In this case, the permanent magnet 11 accommodated inside the cylinder 13 is positioned at the lower end 13*b* of the cylinder 13. Therefore, when the rotating drum 120 rotates, the sensing lifter 1 disposed inside the rotating drum 120 rotates together with the rotating drum 120. Then, the permanent magnet 11 of the energy harvester 10 inside the sensing lifter 1 moves up and down along the cylinder 13, so that electric power is generated.

In this case, when the rotating drum 120 rotates once, the sensing lifter 1 rotates 360 degrees so that the permanent magnet 11 of the energy harvester 10 passes through the coil 12 provided in the center of the cylinder 13 twice. In other words, the permanent magnet 11 of the energy harvester 10 may pass through the coil 12 twice in one rotation of the rotating drum 120.

Figure 12A:
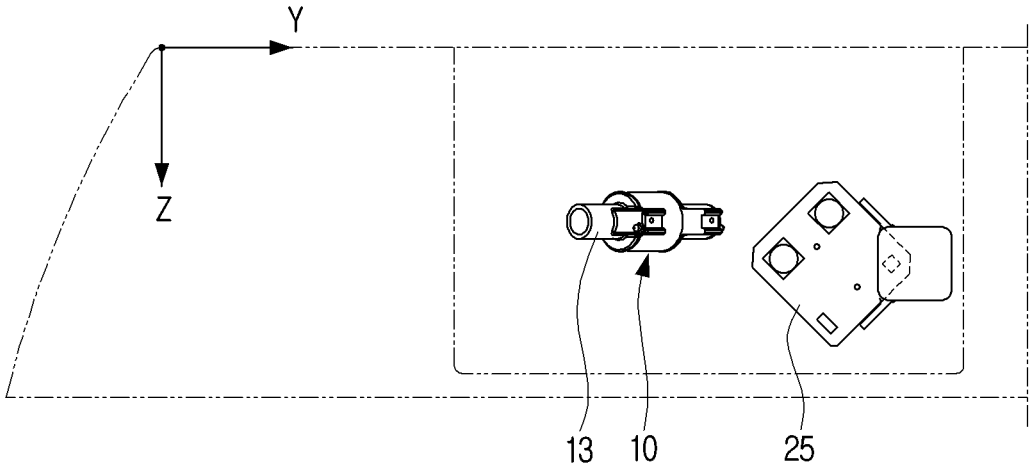
FIGS. 12A and 12B are a partial front view and a partial plan view illustrating a lifter in which a cylinder of an energy harvester is disposed in the X-Y plane at an angle to the Y-axis.
Figure 12B:
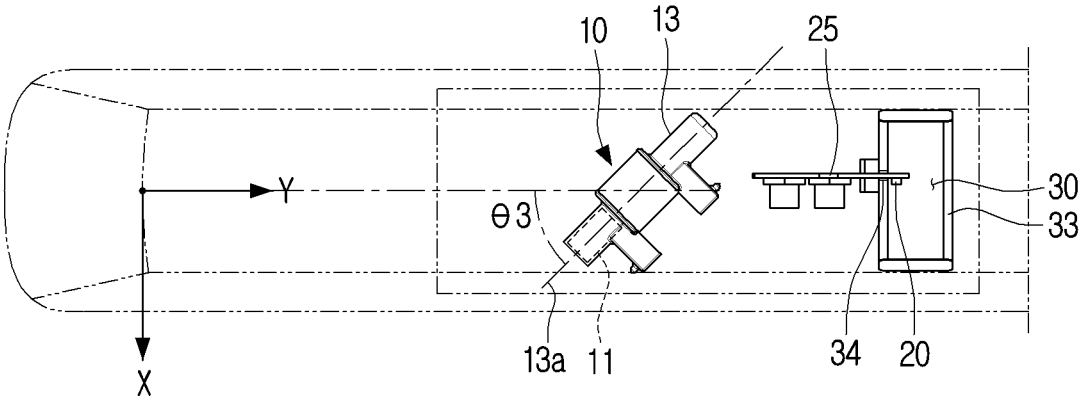

As another example, as illustrated in FIGS. 12*a* and 12*b*, the cylinder 13 of the energy harvester 10 is disposed inclined so that the central axis 13*a* of the cylinder 13 forms an acute angle θ3 with respect to the Y axis in the X-Y plane.

FIGS. 12*a* and 12*b* are a partial front view and a partial plan view illustrating a lifter in which a cylinder of an energy harvester is disposed in the X-Y plane at an angle to the Y-axis. For reference, in FIGS. 12*a* and 12*b*, the lifter 1 is indicated by a virtual line to clearly show the arrangement of the cylinder 13 of the energy harvester 10.

Referring to FIGS. 12*a* and 12*b*, the cylinder 13 of the energy harvester 10 is disposed so that the central axis 13*a* of the cylinder 13 is located on the X-Y plane and forms a predetermined angle θ3, for example, an acute angle with respect to the Y axis. As illustrated in FIG. 12*b*, the cylinder 13 is inclined at an acute angle with respect to the Y axis, and is inclined at an acute angle with respect to the X axis. Then, one end and the body of the inclined cylinder 13 are visible on the Y-Z plane as illustrated in FIG. 12*a*.

In this case, the permanent magnet 11 accommodated inside the cylinder 13 is positioned at one end of the cylinder 13. Therefore, when the rotating drum 120 rotates, the sensing lifter 1 disposed inside the rotating drum 120 rotates together with the rotating drum 120. Then, the permanent magnet 11 of the energy harvester 10 inside the sensing lifter 1 moves up and down along the cylinder 13, so that electric power is generated.

In this case, when the rotating drum 120 rotates once, the sensing lifter 1 rotates 360 degrees around the central axis CA of the rotating drum 120 so that the permanent magnet 11 of the energy harvester 10 passes through the coil 12 provided in the center of the cylinder 13 twice. In other words, the permanent magnet 11 of the energy harvester 10 may pass through the coil 12 twice in one rotation of the rotating drum 120.

Figure 13A:
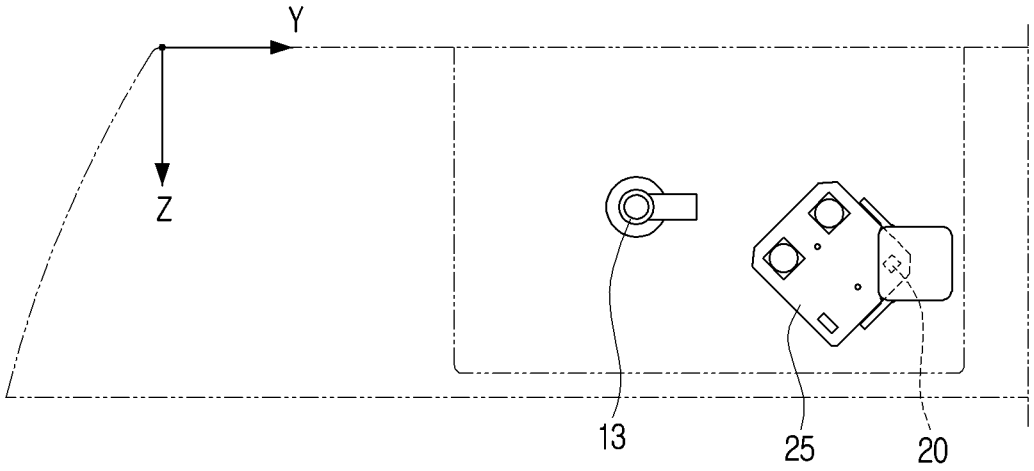
FIGS. 13A and 13B are a partial front view and a partial plan view illustrating a lifter in which a cylinder of an energy harvester is disposed perpendicularly to the Y-axis in the X-Y plane.
Figure 13B:
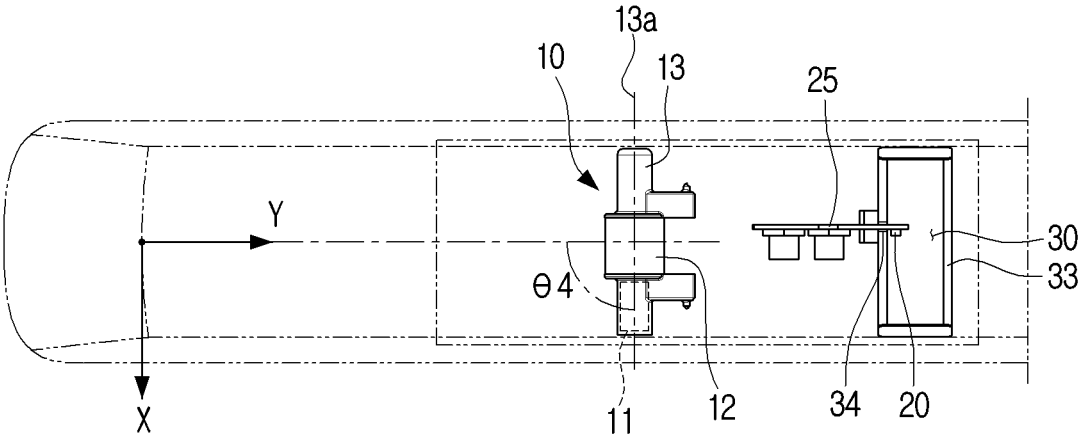

As another example, as illustrated in FIGS. 13*a* and 13*b*, the cylinder 13 of the energy harvester 10 may be disposed so that the central axis 13*a* of the cylinder 13 forms a right angle θ4 with respect to the Y axis in the X-Y plane.

FIGS. 13*a* and 13*b* are a partial front view and a partial plan view illustrating a lifter in which a cylinder of an energy harvester is disposed perpendicularly to the Y-axis in the X-Y plane. For reference, in FIGS. 13*a* and 13*b*, the lifter 1 is indicated by a virtual line to clearly show the arrangement of the cylinder 13 of the energy harvester 10.

Referring to FIGS. 13*a* and 13*b*, the cylinder 13 of the energy harvester 10 is disposed so that the central axis 13*a* of the cylinder 13 is located on the X-Y plane and forms a right angle θ4 with respect to the Y axis. As illustrated in FIG. 13*b*, the cylinder 13 is perpendicular to the Y axis and parallel to the X axis. Then, one end of the circular cylinder 13 is visible on the Y-Z plane as illustrated in FIG. 13*a*.

In this case, the permanent magnet 11 accommodated inside the cylinder 13 is positioned at one end of the cylinder 13. Therefore, when the rotating drum 120 rotates, the sensing lifter 1 disposed inside the rotating drum 120 rotates together with the rotating drum 120. Then, the permanent magnet 11 of the energy harvester 10 inside the sensing lifter 1 moves up and down along the cylinder 13, so that electric power is generated.

In this case, when the rotating drum 120 rotates once, the sensing lifter 1 rotates 360 degrees around the central axis CA of the rotating drum 120 so that the permanent magnet 11 of the energy harvester 10 passes through the coil 12 provided in the center of the cylinder 13 twice. In other words, the permanent magnet 11 of the energy harvester 10 may pass through the coil 12 twice in one rotation of the rotating drum 120.

Figure 14A:
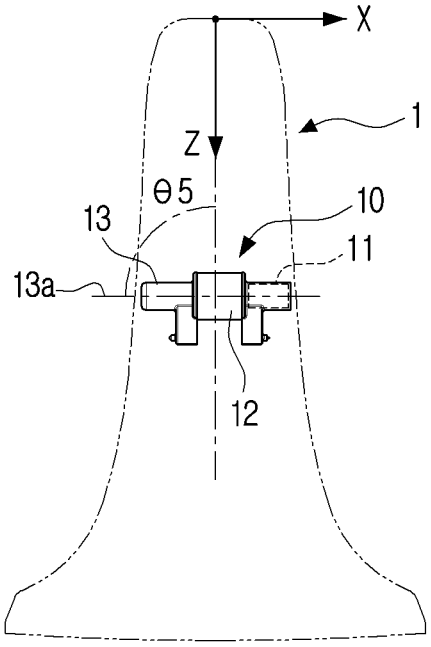
FIGS. 14A, 14B and 14C are side views illustrating a lifter in which a cylinder of an energy harvester is disposed in the X-Z plane.
Figure 14B:
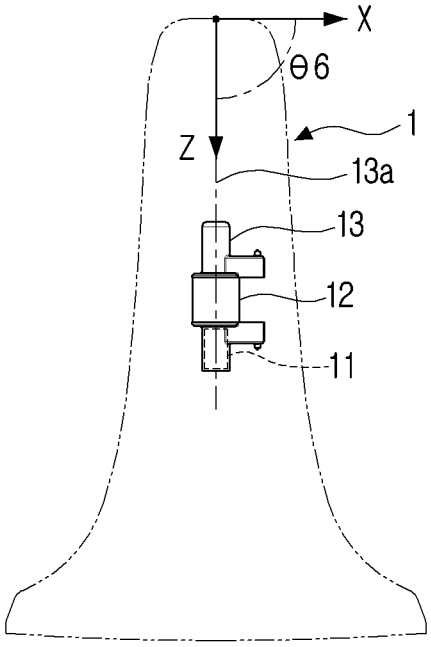
Figure 14C:
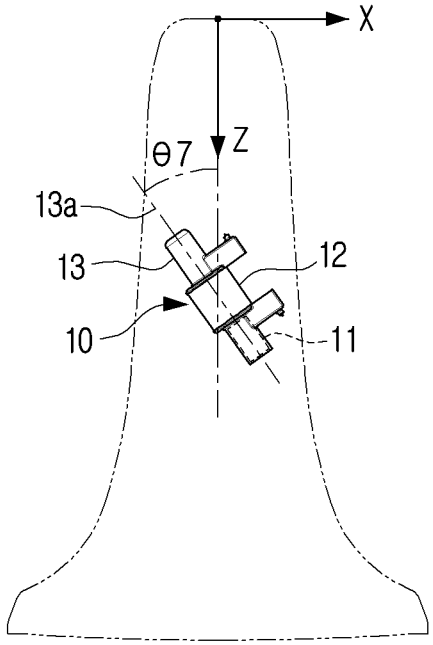

As another example, as illustrated in FIGS. 14A, 14B and 14C, the cylinder 13 of the energy harvester 10 may be disposed so that the central axis 13*a* of the cylinder 13 is located in the X-Z plane.

FIGS. 14A, 14B and 14C are side views illustrating a lifter in which a cylinder of an energy harvester is disposed in the X-Z plane. For reference, in FIGS. 14A, 14B and 14C, the lifter 1 is indicated by a virtual line to clearly show the arrangement of the cylinder 13 of the energy harvester 10.

Referring to FIG. 14*a*, the cylinder 13 of the energy harvester 10 may be disposed so that the cylinder 13 forms a right angle θ5 with respect to the Z axis and is parallel to the X axis. In this case, the permanent magnet 11 accommodated inside the cylinder 13 is located at one end of the cylinder 13.

Referring to FIG. 14*b*, the cylinder 13 of the energy harvester 10 may be disposed so that the cylinder 13 forms a right angle θ6 with respect to the X axis and is parallel to the Z axis. In this case, the permanent magnet 11 accommodated inside the cylinder 13 is located at the lower end of the cylinder 13.

Referring to FIG. 14*c*, the cylinder 13 of the energy harvester 10 may be disposed so that the cylinder 13 forms a predetermined angle θ7, for example, an acute angle with respect to the Z axis and forms an acute angle with respect to the X axis. In this case, the permanent magnet 11 accommodated inside the cylinder 13 is located at the lower end of the cylinder 13.

As described above, when the central axis 13*a* of the cylinder 13 is located on the X-Z plane, the cylinder 13 forms a certain angle with respect to the Y axis rather than zero (0) degrees. Therefore, when the rotating drum 120 rotates once, the sensing lifter 1 rotates 360 degrees around the central axis CA of the rotating drum 120, so that the permanent magnet 11 of the energy harvester 10 passes through the coil 12 provided in the center of the cylinder 13 twice. In other words, the permanent magnet 11 of the energy harvester 10 may pass through the coil 12 twice in one rotation of the rotating drum 120.

Therefore, as illustrated in FIGS. 14A, 14B and 14C, in the case in which the cylinder 13 of the energy harvester 10 is disposed in the X-Z plane, when the rotating drum 120 rotates, the energy harvester 10 of the sensing lifter 1 may generate power.

With the dryer according to an embodiment of the disclosure having the above-described structure, the lifter disposed on the inner surface of the rotating drum measures the humidity inside the rotating drum and wirelessly transmits the humidity data, so that the drying degree of the object to be dried inside the rotating drum may be measured accurately and conveniently.

With the dryer according to an embodiment of the disclosure having a lifter with the above structure, because power is generated by the energy harvester as the rotating drum rotates, power may be supplied to the humidity sensor and the wireless communication part provided in the lifter of the rotating drum without a separate power source. Therefore, because a separate power source such as a battery is not required, the disclosure may be applied to a high-temperature environment such as the inside of the dryer.

The disclosure has been described above in an exemplary manner. The terms used herein are for the purpose of description and should not be construed in a limiting sense. Various modifications and variations of the disclosure are possible according to the above contents. Accordingly, unless otherwise stated, the disclosure may be practiced freely within the scope of the claims.

What is claimed is:

1. A dryer comprising:

a rotating drum;

a lifter positionable on an inner surface of the rotating drum;

an energy harvester, positionable inside the lifter, so that while the energy harvester is positioned inside the lifter, the energy harvester generates electric power as the rotating drum rotates while the lifter is positioned on the inner surface of the rotating drum;

a humidity sensor, positionable inside the lifter, so that while the humidity sensor is positioned inside the lifter, the humidity sensor receives the electric power generated by the energy harvester and senses humidity;

a circuit board, positionable inside the lifter, the humidity sensor being disposed on the circuit board; and an air passage formed through the lifter so as to allow air inside the rotating drum to pass through the lifter, wherein the humidity sensor senses the humidity according to air passing through the air passage of the lifter.

2. The dryer of claim 1, wherein the air passage includes an inlet formed on a front surface of the lifter and an outlet formed on a rear surface of the lifter facing the front surface.

3. The dryer of claim 2, wherein the air passage includes a connection duct that connects the inlet and the outlet and is formed to allow the air inside the rotating drum to pass therethrough, and the humidity sensor is provided on a portion of the circuit board protruding into the connection duct.

4. The dryer of claim 2, wherein a lint filter for blocking lint is disposed in each of the inlet and the outlet.

5. The dryer of claim 1, further comprising:

a waterproof filter disposed on the circuit board to cover the humidity sensor and configured to pass moisture in a gas phase and block water droplets.

6. The dryer of claim 1, wherein the energy harvester comprises:

a cylinder fixed inside the lifter;

a coil wound around the cylinder; and a permanent magnet slidably inserted into the cylinder.

7. The dryer of claim 6, wherein the cylinder is disposed so that a central axis of the cylinder is not parallel to a Y axis passing through a upper surface of the lifter and parallel to a central axis of the rotating drum.

8. The dryer of claim 7, wherein the cylinder is disposed inclined so that the central axis of the cylinder forms an acute angle with respect to the Y axis on a Y-Z plane.

9. The dryer of claim 7, wherein the cylinder is disposed so that the central axis of the cylinder forms a right angle with respect to the Y axis on a Y-Z plane.

10. The dryer of claim 7, wherein the cylinder is disposed inclined so that the central axis of the cylinder forms an acute angle with respect to the Y axis on a X-Y plane.

11. The dryer of claim 7, wherein the cylinder is disposed so that the central axis of the cylinder forms a right angle with respect to the Y axis on a X-Y plane.

12. The dryer of claim 6, wherein a space is provided inside the lifter, and a cylinder fixing part for fixing the cylinder and a board fixing part for fixing the circuit board are provided on an inner surface of the lifter.

13. The dryer of claim 1, further comprising:

a wireless communication part configured to transmit data sensed by the humidity sensor to an outside; and a power supply configured to store the electric power generated by the energy harvester and supply the electric power to the humidity sensor and the wireless communication part, wherein the wireless communication part and the power supply are mounted on the circuit board.

14. The dryer of claim 1, wherein the energy harvester, the humidity sensor, the circuit board, and the air passage are formed in a sensing block, and the lifter includes a mounting portion in which the sensing block is detachably disposed.

15. A dryer comprising:

a rotating drum;

a lifter positionable on an inner surface of the rotating drum, the lifter formed to include an accommodation space;

an energy harvester including a cylinder positionable in the accommodation space of the lifter so that while the energy harvester is accommodated in the accommodation space, the energy harvester generates power while the rotating drum rotates;

a humidity sensor, positionable in the accommodation space of the lifter so that while the humidity sensor is accommodated in the accommodation space, the humidity sensor receives the power generated by the energy harvester and senses humidity;

a circuit board, positionable in the accommodation space of the lifter, so that while the circuit board is accommodated in the accommodation space, the humidity sensor is disposed on the circuit board; and an air passage formed through the lifter and guide air inside the rotating drum to pass to the humidity sensor through the lifter, wherein the cylinder of the energy harvester is disposed so that a central axis of the cylinder forms a predetermined angle rather than zero (0) degree with respect to a Y axis that passes through an upper surface of the lifter and is parallel to a central axis of the rotating drum.

* * * * *